United States Patent [19]

Sando et al.

[11] 4,393,532

[45] Jul. 19, 1983

[54] METHOD FOR CONTINUOUS DELUSTERING HIGH TEMPERATURE TREATMENT OF A TEXTILE PRODUCT AND AN APPARATUS THEREFOR

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 254,427

[22] Filed: Apr. 15, 1981

[30] Foreign Application Priority Data

Apr. 15, 1980 [JP] Japan ..... 55-49292
Apr. 15, 1980 [JP] Japan ..... 55-50632[U]

[51] Int. Cl.[3] ..... D06B 3/12
[52] U.S. Cl. ..... 8/149.1; 8/149.3; 68/5 D; 68/158
[58] Field of Search ..... 8/149.1, 149.2, 149.3; 68/5 D, 5 E, 158, 175

[56] References Cited

U.S. PATENT DOCUMENTS 3,079,699 3/1963 Fry, Jr. ..... 68/5 D X
4,055,970 11/1977 Sando et al. ..... 68/5 E

*Primary Examiner*—Philip R. Coe
*Attorney, Agent, or Firm*—Toren, McGeady and Stanger

[57] ABSTRACT

A method of and apparatus for continuous delustering high temperature treatment of a textile product comprising including subjecting a textile product such as yarns, a strip and a cloth to be treated to steaming while transporting the textile product continuously through a steamer body maintained with a high temperature wet heat under an elevated pressure by means of a plurality of guide rolls provided in the steamer body, and the steaming of the textile product is done in the presence of a water film between each of the guide rolls and the textile product guided therewith. Continuous processings of a textile product, such as pretreatment, dyeing and weight reduction, can be done effectively by preventing the occurrence of lustering and flattening of the textile product.

9 Claims, 4 Drawing Figures

METHOD FOR CONTINUOUS DELUSTERING HIGH TEMPERATURE TREATMENT OF A TEXTILE PRODUCT AND AN APPARATUS THEREFOR

BACKGROUND OF THE INVENTION

The present invention relates to a method of and an apparatus for continuous high temperature treatment of a textile product such as yarns, a strip and a cloth in a high pressure steamer by preventing the occurrence of lustering of the surface or the textile product which is encountered frequently in conventional continuous wet-heat treatments.

In such processings as pretreatment, dyeing and weight reduction of a textile product such as a cloth produced commercially, a method for steaming the textile product soaked with a processing solution continuously by using a high pressure steamer maintained with a high temperature wet heat under pressure has been developed by the present applicant and applied practically. The steaming of a textile product is to treat the textile product in an atmosphere of high temperature and high pressure wet heat by passing the textile product continuously through a high pressure steamer body maintained with a wet heat at a temperature in the range from 100° to about 160° C. under pressure. In the interior of the steamer body, a plurality of cloth guide rolls of metal made are provided for transporting the textile product up and down zigzag in order to prolong the stay period of the textile product in the steamer body.

As above mentioned, however, in such an instance, since the interior of the steamer body is filled with a wet heat at a temperature from 100° to about 160° C., or usually at a temperature about 150° C., the cloth guide rolls of metal provided in the steamer body are also heated to about 150° C. When the textile product contacts directly with the cloth guide rolls at such a high temperature, the textile product receives an ironing effect due to the heat of the guide roll together with contact pressure and friction force particularly when the textile product is composed of chemical fibers, and therefore luster or glaze is caused to occur unavoidably on the surface of the textile product to deteriorate the commodity value of the product. The textile product is also flattened to lower the feeling.

SUMMARY OF THE INVENTION

Under such circumstances, the object of the present invention is to offer an excellent method and apparatus for continuous high temperature treatment of a textile product in a high pressure steamer by preventing the occurrence of lustering of the surface of the textile product and flattening of the textile product.

The essential point of the inventive method comprises, in subjecting a textile product, such as yarns, a strip and a cloth soaked with a processing solution, to steaming while transporting the textile product continuously through a steamer body maintained with a high temperature wet heat under an elevated pressure by means of a plurality of cloth guide rolls provided in the steamer body, steaming the textile product in the presence of a water film between each of the guide rolls and the textile product guided therewith for preventing the direct contact of the textile product with the guide rolls. A water film is formed between each of the guide rolls and the textile product guided thereover by providing a means for retaining water on the surface of the guide roll.

DETAILED DESCRIPTION OF THE PREFERRED EMBODIMENTS

Figure 1:
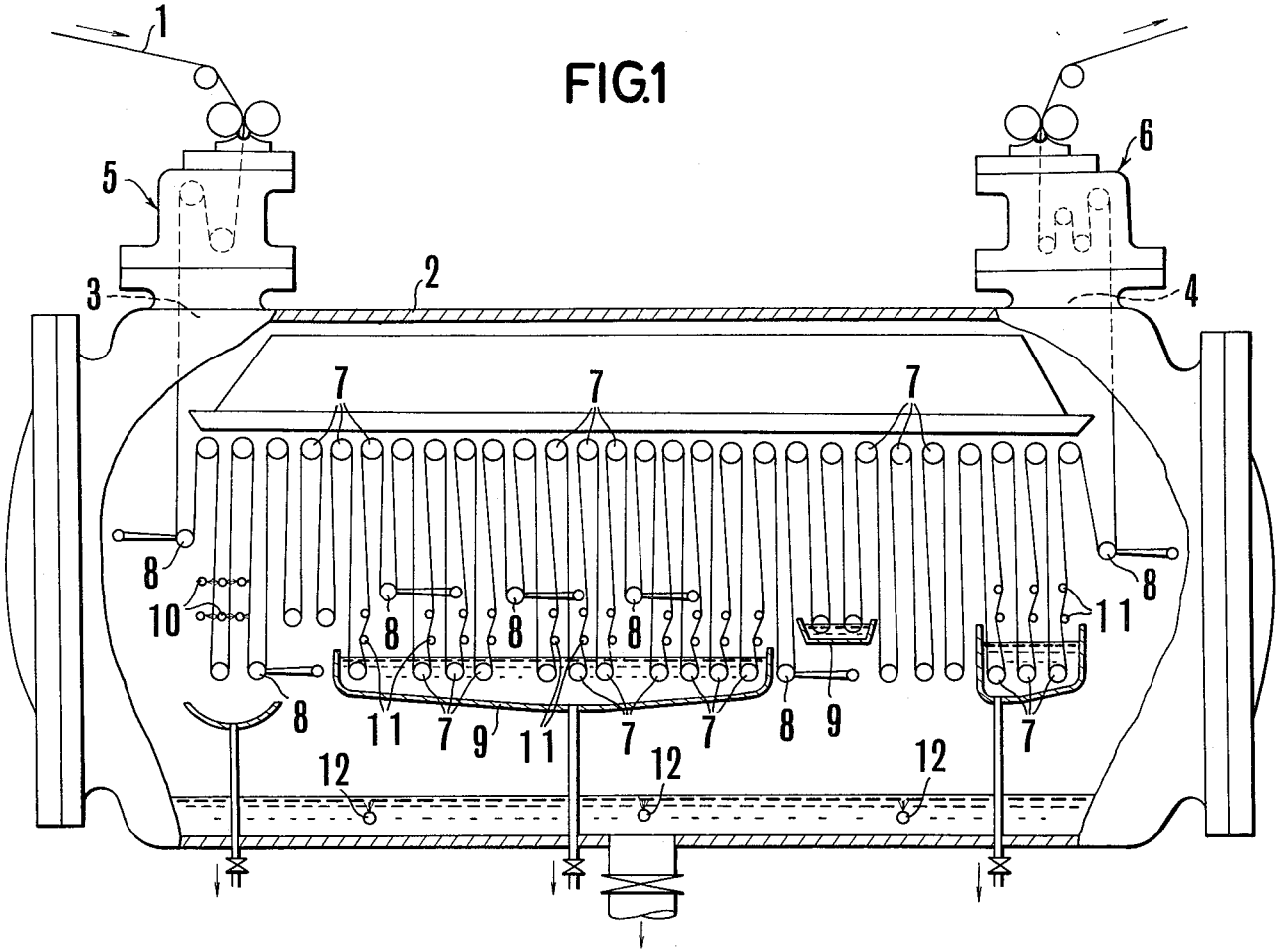
FIG. 1 is a sectional side view of an example of the present inventive apparatus, and FIGS. 2 (*a*), (*b*) and (*c*) are to show the examples of the construction of the inventive guide roll.

An example of the embodiment of the present invention will be illustrated in detail in the following by referring to the drawings attached herewith.

In FIG. 1, 1 is a textile product to be treated, and 2 is a high pressure steamer body for steaming the textile product 1. The textile product 1 is taken in and out of the steamer body 2 continuously. The steamer body 2 is provided with a textile product inlet 3 and a textile product outlet 4, and the textile product inlet 3 and the textile product outlet 4 are provided respectively with an inlet side seal mechanism 5 and an outlet side seal mechanism 6 for allowing the continuous passage of the textile product 1 through the steamer body 2 while maintaining the high temperature and pressure wet heat in the interior of the steamer body 2 without leakage. Various types of the seal mechanism of a steamer body have been disclosed by the present applicants, and any one of them may be applied selectively in the present invention. However, since the seal mechanism of the steamer body is without the scope of the present invention, the explanation of the constructions of the seal mechanisms 5 and 6 will be abridged in this place. 7 are a plurality of cloth guide rolls of metal made provided in an up and down arrangement affording a zigzag path in the steamer body for transporting the cloth continuously there through. Some of the cloth guide rolls 7 are substituted in proper positions with tension control rolls 8 for the textile product.

9 are of a plurality of water tanks provided at the lower part of the steamer body 2 so as to immerse the lower side cloth guide rolls 7 in water therein. In the water tanks 9, a prescribed amount of hot water is supplied stationarily at a temperature in the range from 100° to about 160° C. in accordance with the temperature of the wet heat in the steamer body 2. The textile product passing the lower side guide rolls 7 is soaked with hot water in the water tank 9 intermittently and repeatedly while the textile product is transported continuously through the steamer body 2. While a plurality of water tanks 9 are provided in this example, the water tank may be united as a single long one from side to side. 10 are water jet nozzles for applying hot water to the textile product immediately after the textile product is introduced in the steamer body 2, and 11 are squeeze bars for controlling the water content of the textile product 1 every time when the textile product is taken out of the water tanks 9. Water jet nozzles 10 and the squeeze bars 11 may be dispensed with under certain circumstances. 12 are steam jet pipes for jetting superheated steam in the steamer body 2 so as to maintain the interior of the steamer body with a wet heat at a prescribed temperature.

Figure 2A:
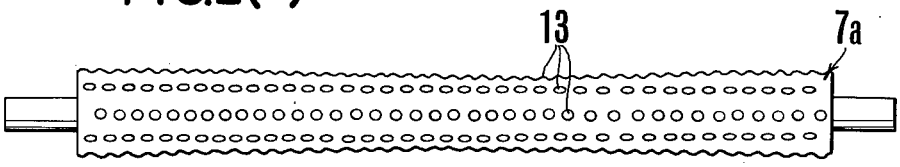
Figure 2B:
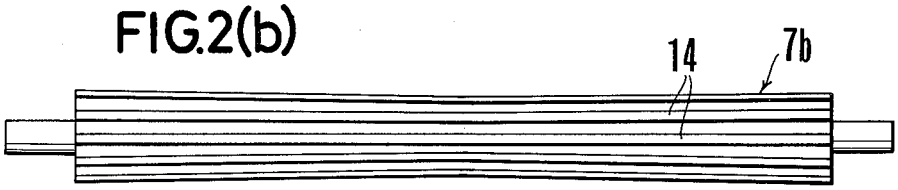
Figure 2C:
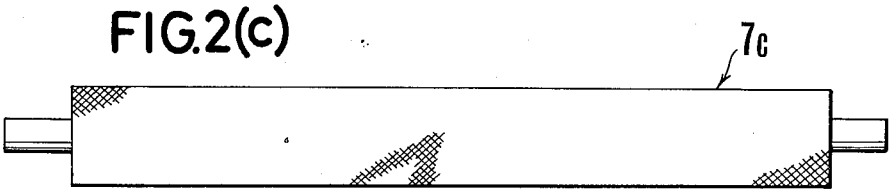

What is most characterized in the present invention is the construction of the guide rolls 7. The cloth guide rolls 7 are designed so as to retain water on the surface thereof for forming a water film between the guide rolls and the textile product guided therewith. An example of the guide roll shown in FIG. 2 (*a*) has a plurality of small projections 13 around the outer circumference of the guide roll in close spacings. Another example shown in FIG. 2 (*b*) has a plurality of projection stripes 14 around the outer circumference of the guide roll in its longitudinal direction in close spacings. The cloth guide rolls in these instances are desirably of a nearly drum-shaped one for preventing the formation of creases in the crosswise direction of the textile product. In a further example shown in FIG. 2 (*c*), a water-retaining substance such as a cloth, asbestos and glass fibers are wound up around the outer circumference of the cloth guide rolls. Under these constructions, a sufficient amount of hot water can be retained on the surface of the cloth guide rolls for forming a water film between each of the guide rolls and the textile product guided therewith.

In steaming a textile product, for instance a cloth 1, soaked with a processing solution such as a dye solution in the above mentioned high pressure steamer, superheated steam is supplied in the steamer body 2 by means of the steam jet pipes 12 so as to maintain the interior of the steamer body with a wet heat at a prescribed temperature of, for instance, 150° C., and hot water is supplied in the water tanks 9 by means of a water pipe (not shown in the figure) externally so as to store a prescribed amount of hot water constantly at the same temperature as the temperature of the wet heat in the steamer body, say 150° C. Then, a cloth to be treated, 1, is introduced in the steamer body 2 for steaming.

In the steamer body 2, the cloth 1 is easily swollen due to wet heat and immediately supplied in hot water in the water tank 9 for soaking the cloth with hot water rapidly and sufficiently up to the core part thereof. The cloth 1 coming out of the water tank 9 is desirably squeezed by means of the squeeze roll 11 for controlling the amount of hot water and further wet-heat treated while the cloth is going up and down zigzag by means of cloth guide rolls 7, and the treatment is repeated successively in a similar way.

Guided by the cloth guide rolls 7, the cloth 1 is soaked with hot water and then wet-heat treated alternately and repeatedly, so that the cloth is processed, for instance, dyed, effectively and uniformly up to the core part thereof. In the present invention, particularly, the guide rolls are designed so as to retain a sufficient amount of water on the surface thereof, so that a water film is formed between the cloth guide roll and the cloth always in passing the cloth through the guide rolls. Due to the existence of a water film therefore, the ironing action of the cloth guide roll heated at a temperature as high as 150° C. to the cloth can perfectly be prevented, and there is entirely no trouble that the surface of the cloth treated is lustered. The flattening of the cloth can also be prevented.

As above described in detail, the present invention is, in subjecting a textile product such as yarns, a strip and a cloth soaked with a processing solution to steaming while transporting the textile product continuously through a steamer body maintained with a wet heat at high temperature and pressure by means of a plurality of cloth guide rolls made of metal provided up and down zigzag in the steamer body, steaming the textile product in the presence of a water film between each of the guide rolls and the textile product guided therewith, the water film being provided with the aid of a means for retaining water on the surface of the guide roll, for preventing the direct contact of the textile product with the cloth guide rolls heated as high as 100° to 160° C. Therefore, the ironing action of the cloth guide roll on the textile product can perfectly be prevented for preventing that the surface of the textile product is lustered and that the textile product is flatten, and thus continuous steaming of a textile product can be done effectively to produce an excellent finished product having no tendency that the surface thereof is lustered and the textile product is flatten to miss the feeling thereof.

What is claimed is:

1. A method for continuous delustering high temperature treatment of a textile product comprising subjecting a textile product such as yarns, a strip and a cloth to be treated to steaming while transporting the textile product continuously through a steamer body maintained with a high temperature wet heat under an elevated pressure, guiding the textile product over a plurality of cloth guide rolls provided in the steamer body, and maintaining a water film between each of the guide rolls and the textile product guided therewith for preventing that the surface of the textile product is lustered.

2. An apparatus for the continuous delustering high temperature treatment of a textile product comprising a high pressure steamer, a plurality of axially extending cloth guide rolls located within said steamer and arranged to transport the textile product continuously through the steamer body, said cloth guide rolls arranged to move the textile product in an up and down zigzag path through said steamer with the textile product passing around and in contact with said cloth guide rolls, means for maintaining a high temperature wet heat within said steamer, means for supplying heated water to at least certain of said cloth guide rolls, and said cloth guide rolls each including means for maintaining a water film between each said cloth guide roll and the textile product guided thereover.

3. An apparatus for the continuous delustering high temperature treatment of a textile product according to claim 2, wherein said means for maintaining a water film comprises a plurality of small projections around and along the outer circumference of the guide roll with said small projections closely spaced apart and projecting outwardly from the outer surface of said guide roll.

4. An apparatus for the continuous delustering high temperature treatment of a textile product according to claim 2, wherein said means for maintaining a water film comprises a plurality of radially outwardly projecting stripes extending along and in the axial direction of the outer circumference of said guide roll with said stripes being closely spaced apart.

5. An apparatus for the continuous delustering high temperature treatment of a textile product according to claim 3 or 4, in which said cloth guide rolls are of a nearly drum-shaped configuration.

6. An apparatus for the continuous delustering high temperature treatment of a textile product according to claim 2, wherein said means for maintaining a water film comprises a substance having a property of retaining water wound around the outer circumference of the guide roll.

7. An apparatus for the continuous delustering high temperature treatment of a textile product according to claim 6, wherein said substance comprises a cloth.

8. An apparatus for the continuous delustering high temperature treatment of a textile product according to claim 6, wherein said substance comprises asbestos.

9. An apparatus for the continuous delustering high temperature treatment of a textile product according to claim 6, wherein said substance comprises glass fibers.

* * * * *